US006778144B2

(12) United States Patent
Anderson

(10) Patent No.: US 6,778,144 B2
(45) Date of Patent: Aug. 17, 2004

(54) ANTENNA

(75) Inventor: Joseph M. Anderson, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/186,556

(22) Filed: Jul. 2, 2002

(65) Prior Publication Data

US 2004/0004576 A1 Jan. 8, 2004

(51) Int. Cl.[7] ..... H01Q 13/10
(52) U.S. Cl. ..... 343/767; 343/771
(58) Field of Search ..... 343/767, 770, 343/771, 789

(56) References Cited

U.S. PATENT DOCUMENTS

| | | | | | |
|---|---|---|---|---|---|
| 3,653,052 | A | | 3/1972 | Campbell et al. | 343/771 |
| 3,938,158 | A | | 2/1976 | Birch et al. | 343/756 |
| 3,971,125 | A | | 7/1976 | Thies, Jr. | 29/601 |
| 4,130,822 | A | | 12/1978 | Conroy | 343/767 |
| 4,197,545 | A | | 4/1980 | Favaloro et al. | 343/767 |
| 4,386,357 | A | | 5/1983 | Patton | 342/700 MS |
| 4,531,130 | A | | 7/1985 | Powers et al. | 343/767 |
| 4,554,549 | A | | 11/1985 | Fassett et al. | 343/700 MS |
| 4,590,478 | A | | 5/1986 | Powers et al. | 343/770 |
| 4,660,048 | A | | 4/1987 | Doyle | 343/700 MS |
| 4,866,451 | A | | 9/1989 | Chen | 343/700 MS |
| 4,916,457 | A | * | 4/1990 | Foy et al. | 343/770 |
| 4,958,165 | A | * | 9/1990 | Axford et al. | 343/770 |
| 5,008,681 | A | | 4/1991 | Cavallaro et al. | 343/700 MS |
| 5,025,264 | A | | 6/1991 | Stafford | 343/767 |
| 5,081,466 | A | | 1/1992 | Bitter, Jr. | 343/767 |
| 5,187,490 | A | | 2/1993 | Ohta et al. | 343/770 |
| 5,400,040 | A | | 3/1995 | Lane et al. | 343/700 MS |
| 5,489,913 | A | * | 2/1996 | Raguenet et al. | 343/767 |
| 5,539,420 | A | | 7/1996 | Dusseux et al. | 343/769 |
| 5,880,694 | A | | 3/1999 | Wang et al. | 343/700 MS |
| 5,886,667 | A | | 3/1999 | Bondyopadhayay | 343/700 MS |
| 5,923,296 | A | | 7/1999 | Sanzgiri et al. | 343/700 MS |
| 5,982,338 | A | | 11/1999 | Wong | 343/853 |
| 6,025,809 | A | | 2/2000 | Lane et al. | 343/772 |
| 6,097,345 | A | | 8/2000 | Walton | 343/769 |

FOREIGN PATENT DOCUMENTS

| | | |
|---|---|---|
| DE | 41 20 521 A 1 | 3/1992 |

* cited by examiner

*Primary Examiner*—Michael C. Wimer
(74) *Attorney, Agent, or Firm*—Renner, Otto, Boisselle & Sklar, LLP

(57) ABSTRACT

An antenna element (20) comprising a first conductive plane (22), a second conductive plane (24), and one or more dielectric layers (26, 28, 30) separating the first and second conductive planes (22 and 24). A resonant cavity (48) is formed by a portion of the first conductive plane (22), a portion of the second conductive plane (24) and electrical connections (e.g., plated vias(40)) extending therebetween. A slot (32) is formed in the portion of the second conductive plane (24) forming one side of the resonant cavity (48) and the feedline (34) extends into the cavity (48).

17 Claims, 5 Drawing Sheets

ANTENNA

This invention was made with Government support under Contract No. DASG60-90-C-0166 awarded by the Department of the Army. The Government has certain rights in this invention.

FIELD OF THE INVENTION

The present invention relates generally as indicated to an antenna and, more particularly, to an antenna element that has a stripline feed and can be easily incorporated into low cost, light weight antenna arrays.

BACKGROUND OF THE INVENTION

An antenna system can comprise an array of antenna elements arranged, for example, in eight two-by-two arrays. One form of an antenna element, commonly called a patch antenna, comprises a planar patch of conductive material that serves as its radiating component. Patch antennas have traditionally been viewed as being inexpensive to manufacture and as being easily incorporated into low cost, light weight antenna arrays.

In a patch antenna element, the conductive patch is formed on a dielectric layer by, for example, etching, and other known techniques usually requiring skilled touch labor. The dielectric layer supports the patch and positions it parallel to a conductive ground plane and a feed is provided to communicate electromagnetic energy to or from the patch. Typically, the ground plane and the feed will be part of a stripline circuit positioned under the patch and its supporting dielectric layer.

A stripline circuit usually comprises a compilation of boards press-bonded or otherwise joined together. The outer surface of each of dielectric boards has a conductive coating (e.g., copper cladding) thereon and plated vias between the conductive coatings and through the dielectric boards. A conductive feedline is formed on one board's inner surface. With a coaxial connection, the outer conductor is connected to one of the conductive coatings and the inner conductor is connected to the feedline which in turn is electrically connected to the patch.

The electrical connection between the patch and the stripline feed can be accomplished by a coaxial-coupling pin welded to the patch and extending through the patch's supporting layer and the adjacent stripline layer, with appropriate insulation provided in the conductive coating, to the feed. In an antenna system comprising eight two-by-two arrays, thirty-two pins, welds, aligned openings, and insulated passages would be necessary. These pins can be replaced by coupling slots, provided that the slot is bent or otherwise configured to be longer than the patch and that the slot does not cause spurious radiation.

SUMMARY OF THE INVENTION

The present invention provides a "patchless" antenna element that is just as easily incorporated into an antenna array as a conventional patch antenna element. The antenna element can be constructed without coaxial coupling pins and without patch radiators (and the corresponding support layer). The elimination of these conventionally necessary components greatly reduces antenna cost, weight and/or packaging. The antenna element can generate circular polarization thereby resulting in higher efficiency and greater circular polarization bandwidth.

More particularly, the present invention provides an antenna element comprising a first conductive plane, a second conductive plane, and one or more dielectric layers separating the first and second conductive planes. A resonant cavity is formed by a portion of the first conductive plane, a portion of the second conductive plane, and electrical connections (e.g., plated vias) extending therebetween. A slot is formed in the portion of the second conductive plane forming one side of the resonant cavity and the feedline extends into the cavity. In this manner, a field can be set in the cavity when excited by the feedline and electromagnetic signals coupled to or from the resonant cavity. The central conductor of a coaxial coupling can be connected to the feedline and its outer conductor can be connected to the first conductive plane.

An antenna array can incorporate a plurality of the antenna elements according to the present invention. Such an antenna array can be made by compiling a plurality of boards and extending electrical connections (e.g., plated vias) therebetween. A first board would be made of a dielectric material and have a first conductive coating on one surface and a second board would also be made of a dielectric material and have a second conductive coating on one surface. Slots would be formed in the second conductive coating and a feedline circuitry would be printed on the opposite surface of the second board. The first conductive coating would form the first conductive plane for each of the antenna elements, the second conductive coating would form the second conductive plane for each of the antenna elements, and the feedline circuitry would include the feedline for each of the antenna elements.

The present invention provides these and other features hereinafter fully described and particularly pointed out in the claims, the following description and annexed drawings setting forth in detail a certain illustrative embodiment of the invention, this being indicative, however, of but one of the various ways in which the principles of the invention may be employed.

DRAWINGS

DETAILED DESCRIPTION

Figure 1:
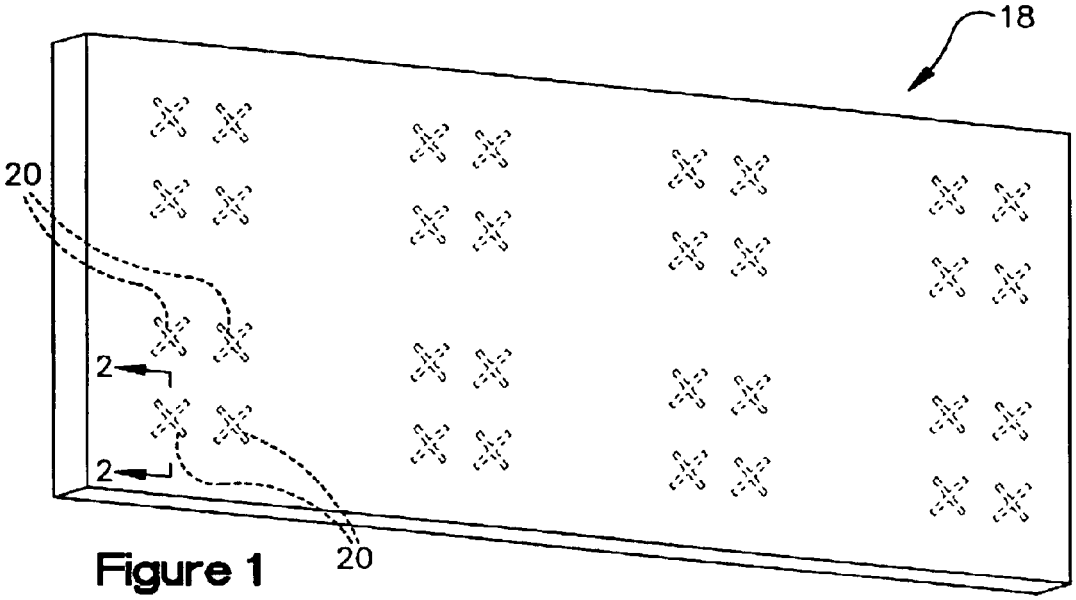
FIG. 1 is a flat planar array antenna incorporating a plurality of antenna elements according to the present invention.

Referring now to the drawings in detail, and initially to FIG. 1, an antenna array 18 incorporating a plurality of antenna elements 20 according to the present invention is shown. The illustrated antenna 18 has a flat, planar structure and comprises thirty-two antenna elements 20 arranged in eight two-by-two arrays. It should be noted, however, that the antenna element 20 of the present invention can instead be incorporated into different sized arrays and/or non-planar antenna structures. Also, although the illustrated antenna element 20 is designed to provide circular polarization, the polarization characteristics can be adapted to accommodate other radiation requirements.

Figure 2:
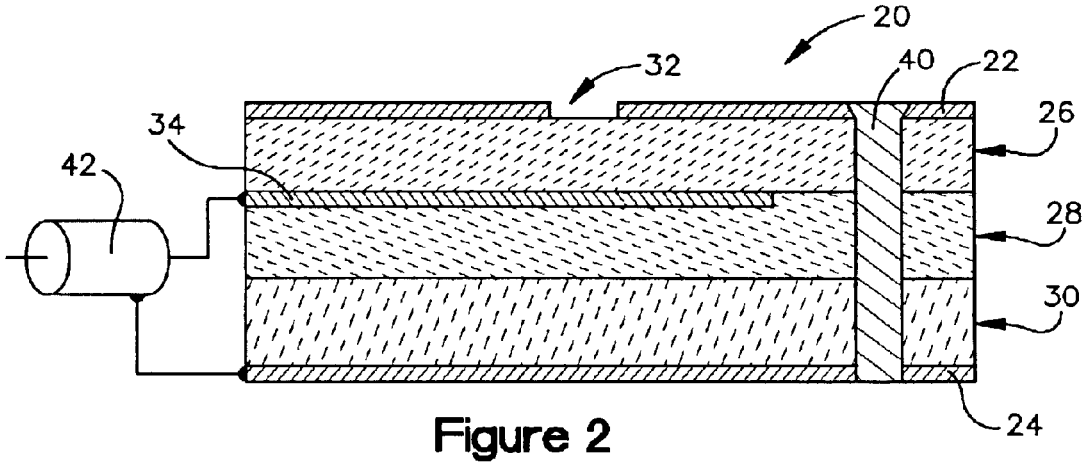
FIG. 2 is a schematic side view of the antenna element.

Referring now to FIG. 2, the antenna element 20 is shown in detail and comprises a first conductive plane 22, a second conductive plane 24, and dielectric layers 26, 28, and 30 separating the conductive planes 22 and 24. The conductive plane 22 includes a non-conductive slot 32 and the antenna element 20 further comprises a feedline 34 positioned between the dielectric layers 26 and 28. Although the illustrated antenna element 20 has three dielectric layers, more or less dielectric layers are contemplated by and possible with the invention. Also, the feedline 34 can be positioned between any two dielectric layers or in any other way which results in it being appropriately positioned.

The first conductive plane 22 can be formed on the top surface of the dielectric layer 26 by, for example, electrodeposition of a copper cladding or by bonding of a copper film plate. The second conductive plane 24 can be formed in a similar manner on the bottom surface of the dielectric layer 30. The slot 32 can be formed by etching or otherwise on the conductive plane 22 and the feedline 34 can be formed by printing or otherwise on the lower surface of the dielectric layer 26.

A plurality of plated vias 40 (or other appropriate conductive interconnect mechanisms) extend between conductive planes 22 and 24 and appropriate openings (shown but not specifically numbered in the drawings) are formed in the dielectric layers 26, 28 and 30 to accommodate the vias 40. A coaxial connector 42 has its central conductor connected to the feedline 34 and its outer conductor connected to the conductive plane 24 because, generally, the central conductor provides the feed signal and the outer conductor is generally grounded.

Figure 3:
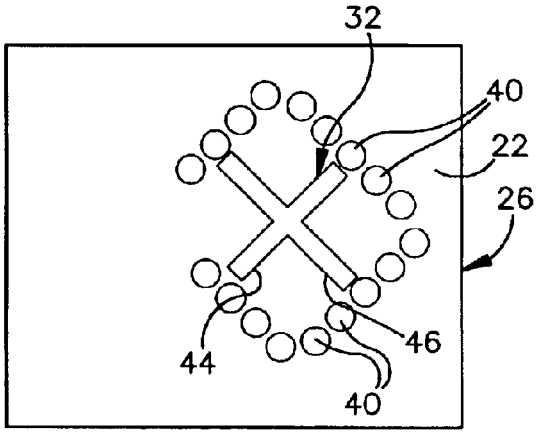
FIG. 3 is a top view of a first layer of the antenna element.
Figure 4:
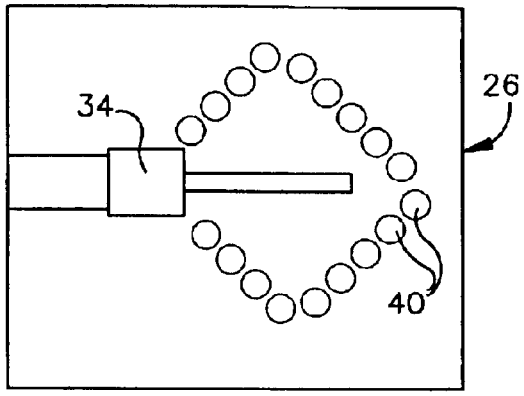
FIG. 4 is a bottom view of the first layer of the antenna element.
Figure 5:
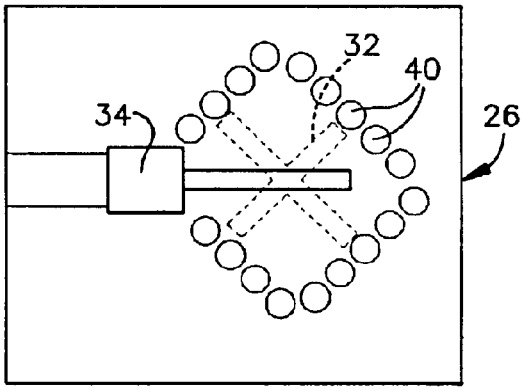
FIG. 5 is a bottom view of the first layer of the antenna element showing the slot in its top surface in phantom.
Figure 6:
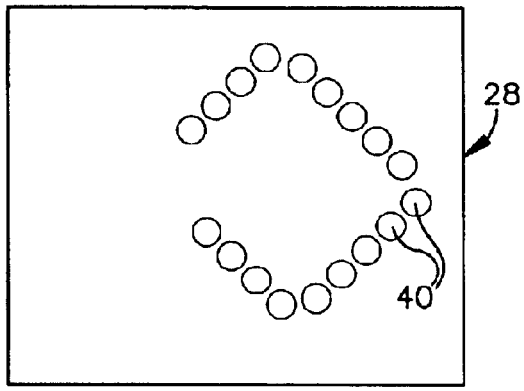
FIG. 6 is a top view of a second layer of the antenna element.
Figure 7:
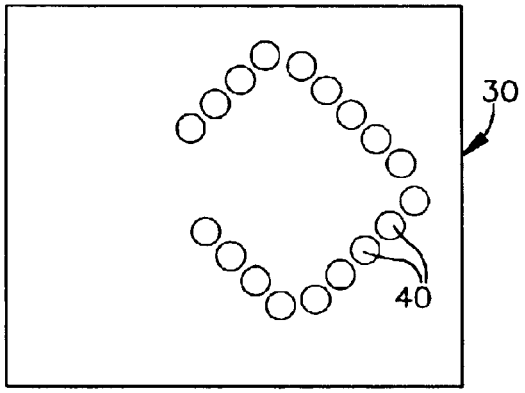
FIG. 7 is a top view of a third layer of the antenna element.

Referring now to FIGS. 3–7, the dielectric layers 26, 28 and 30 of the antenna element 20 are illustrated isolated from each other. As shown in FIG. 3, the slot 32 has a cross shape with two orthogonal sections 44 and 46 and the vias 40 arranged therearound in a square with one open corner. The cross sections 44 and 46 are laterally aligned, respectively, with lines extending between center points of opposite sides of the square. That being said, straight or other non-cross slot geometries are possible with, and contemplated by, the present invention. As shown in FIG. 4, the feedline 34 extends into the vias-formed square through its open corner and, as is shown in FIG. 5, the feedline 34 is transversely aligned with the center of the slot 32. As is shown in FIGS. 6 and 7, the vias 40 extend through the dielectric layers 28 and 30 in the same square pattern as in the dielectric layer 26.

Figure 8:
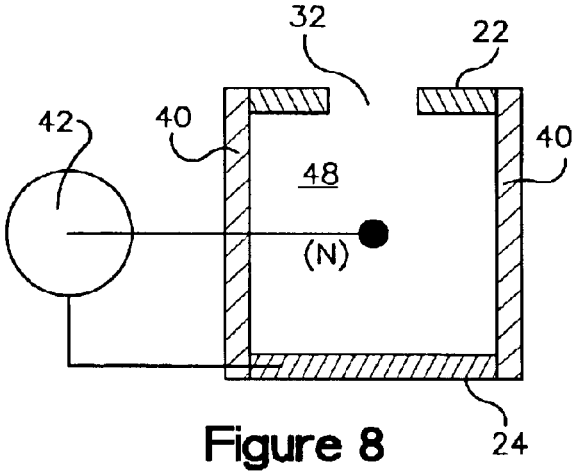
FIG. 8 is a schematic sectional representation showing the cavity formed by the layers of the antenna element.

Referring now to FIG. 8, the resonant cavity 48 of the antenna element 20 is schematically represented. The cavity 48 is formed by a portion of the conductive plane 22, a portion of the conductive plane 24 and the vias 40 extending between these portions. The dimensions of the cavity 48 are selected so that it resonates at a desired frequency (e.g., 44–45 Ghz). During operation of the antenna element 20, the cavity 48 is excited by the feedline 34 by a feed signal which is preferably closely matched to the resonant frequency of the cavity 48 to improve the efficiency of the antenna.

Thus, the antenna element 20 of the present invention has a "patchless" construction in that it does not require a patch for radiating electromagnetic energy. The elimination of the patch, and the corresponding elimination of the patch support layer, can translate into a major savings in time, packaging, and cost. Also, the antenna element 20 can be manufactured without skilled touch labor (e.g., a person having a great deal of experience with assembling small/detailed microcircuitry) thereby minimizing performance problems conventionally connected to this type of labor.

The illustrated antenna element 20 is designed to provide circular polarization of linearly polarized radiation so that, for example, the antenna array 18 can be used in satellite communications. Circular polarization is achieved by the orthogonal slot sections 44 and 46 being positioned with 90° therebetween and setting their lengths so that one slot section (slot section 44 in the illustrated embodiment) is shorter than resonant and the other slot section (slot section 46 in the illustrated embodiment) is slightly longer than resonant. The length difference between the slot sections 44 and 46 is chosen so that there is 90° difference in radiating phase and equality in amplitude. The slot 32 is centered within the cavity 48 so that the tevanescent TE110 mode does not couple to the slot 32 whereby slot efficiency is high. In other words, the cavity mode (TE110) is not excited, whereby the antenna is excited by the stripline feed thereby making the efficiency is high.

Figure 9:
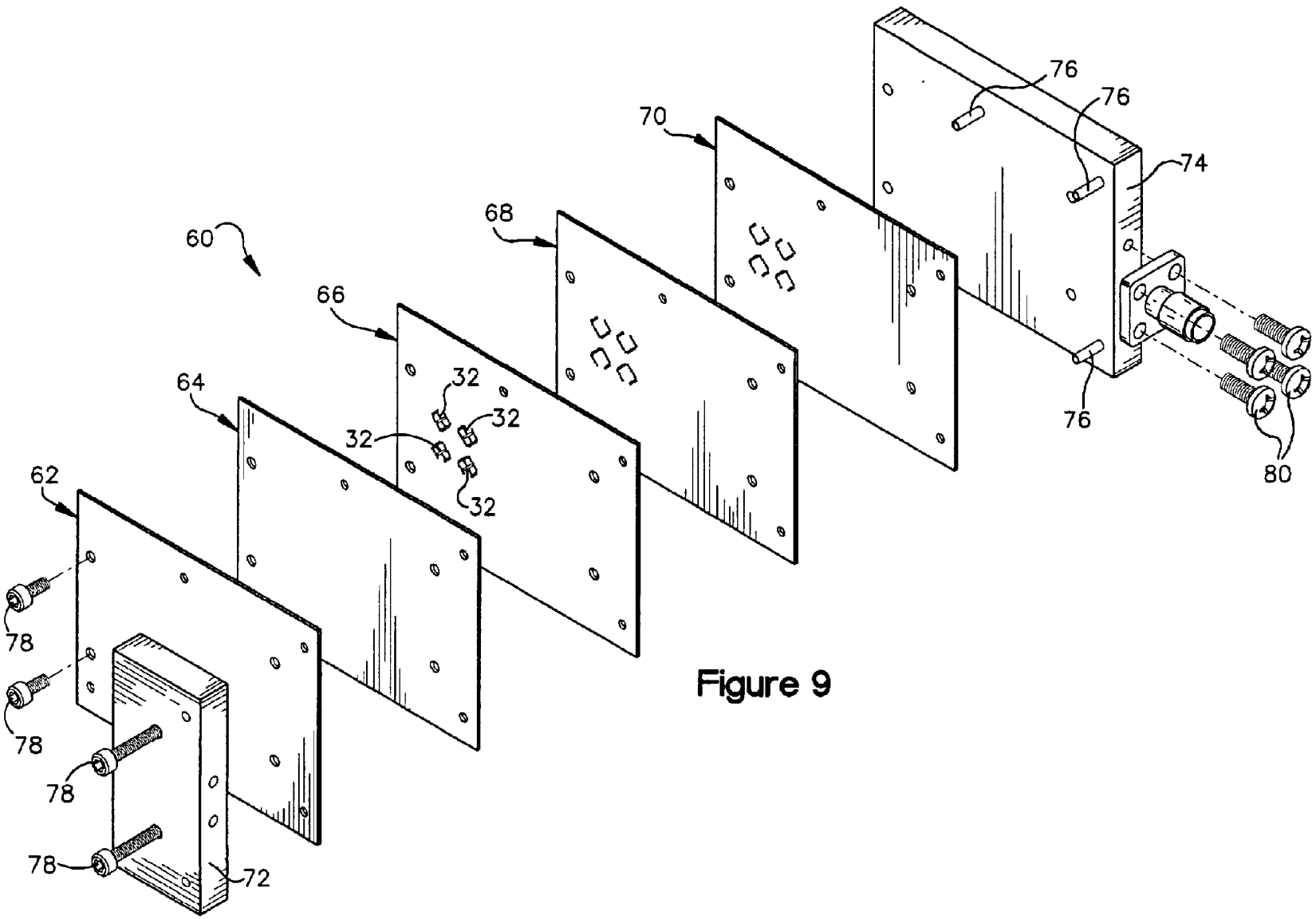
FIG. 9 is an exploded view of a test structure incorporating a two-by-two array of antenna elements according to the present invention.

Referring now to FIG. 9, an exploded view of a test structure 60 for a two-by-two test array of the antenna elements 20 of the present invention is shown. The illustrated test structure 60 comprises boards 62, 64, 66, 68 and 70 sandwiched between plates 72 and 74. The boards and plates each have openings which register with posts 76 and fasteners 78 to correctly align the components and couple them together. The plates 72 and 74 also each have side openings which receive fasteners 80 for attachment of the coaxial connector 42.

The board 62 is a radome layer for protection purposes and the board 64 is a bonding layer for attachment of the radome layer to the rest of the boards. The radome board 62 can be made of a dielectric substrate material such as Duroid 6002 marketed by P. T. Rogers Corporation and can have a thickness of about 0.010 inch. The bonding board 64 can be made of a suitable bonding film.

Figure 10:
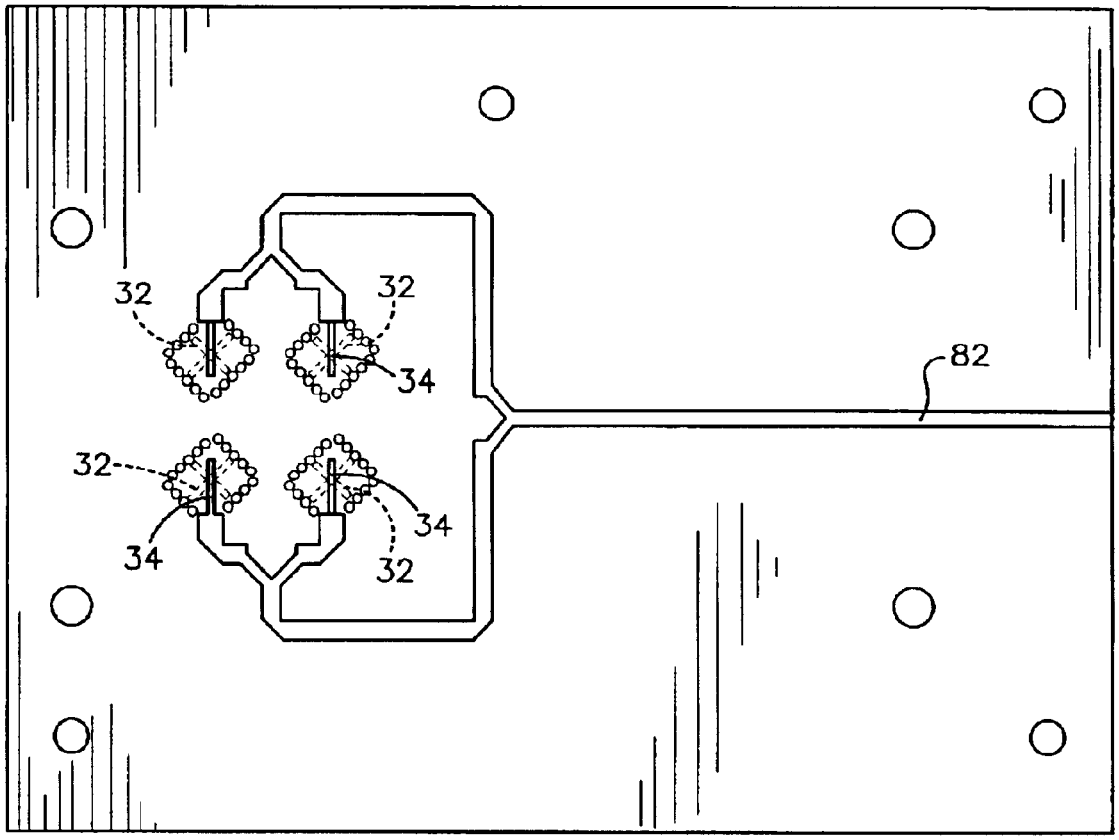
FIG. 10 is a top view of a board of the test structure with the slots on the bottom side of this board being shown in phantom.

The boards 66, 68 and 70 form the antenna layers 22, 24, 26, 28, and 30. The board 66 is made of a dielectric substrate material, such as Duroid 6002 and can have a thickness of about 0.020 inch. One side of the board 66 (the side visible in FIG. 9) has a copper cladding or other suitable coating forming the conductive plane 22 in which slots 32 of elements 20 are etched. The other side of the board 66 (the side hidden in FIG. 9 and visible in FIG. 10) has stripline circuitry 82 printed thereon forming the feedlines 34 for the antenna elements 20. The vias 40 surround each of the slots 32 and feedlines 34 in the shape of an open-corner square.

The board 68 forms a bonding layer between the boards 66 and 70 and can be made of a dielectric bonding film. The board 70 is also made of a dielectric substrate material such as Duroid 6002 and has a thickness of about 0.020 inch. One side of the board 70 (the side hidden in FIG. 9) has a copper cladding forming the ground plane 24 for the antenna elements 20. The vias 40 in these boards are aligned with the vias 40 in the board 66.

The boards 66, 68 and 70 can be stacked as an antenna panel subassembly and the vias 40 used to provide an electrical connection between the conductive plane 22 and the ground plane 24. The stacked boards 66, 68 and 70, and the remaining boards 62 and 64 can then be assembled with the plates 72 and 74 by inserting the posts 76 and the fasteners 78 through the corresponding openings. The coaxial connector 42 is then connected to the plates 72 and 74 with the fasteners 80, this fastening connecting the inner conductor to the stripline circuitry 82 and the outer conductor to the outer surface (e.g., the ground plane 24) of the board 70.

Figure 11:
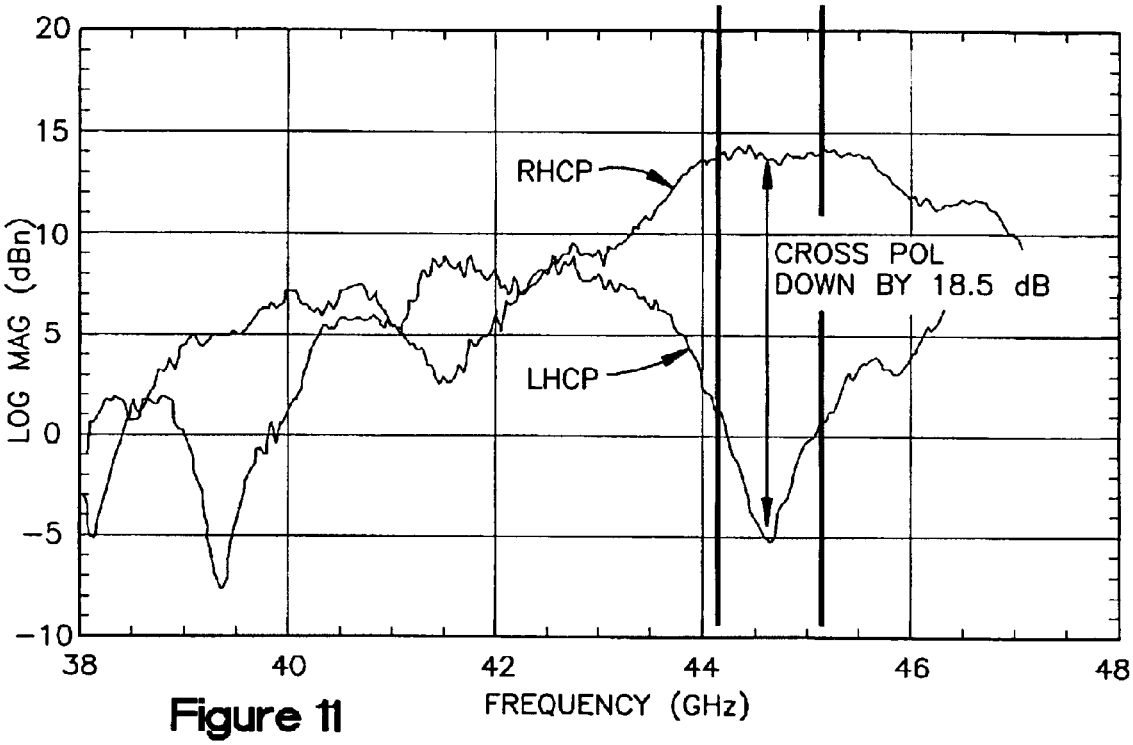
FIG. 11 is a graph showing the cross polarization characteristics in the frequency band of interest.
Figure 12:
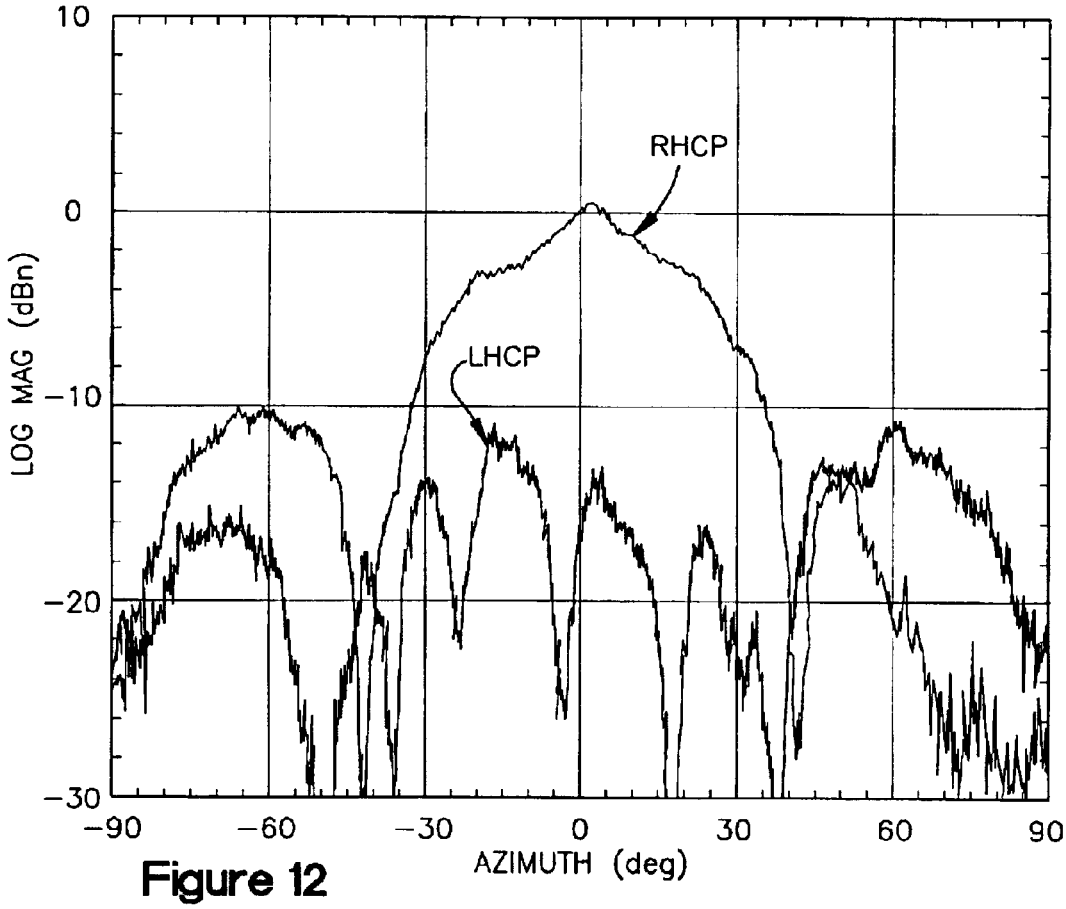
FIG. 12 is a graph showing the circularly polarization radiation patterns of the present invention.

FIGS. 11 and 12 show measured data for the two-by-two test array shown in FIG. 9 which radiates circular polarization in the right hand sense. FIG. 11 shows the gain from the right hand cross polarization (RHCP) and the left hand cross polarization (LHCP) across the frequency band of interest (44–45 Ghz) and reflects that the cross-polarization component is suppressed by nearly 19 dB. FIG. 12 shows the typical radiation pattern in an azimuth range of interest.

It should be noted that the antenna array 18 shown in FIG. 1 can be constructed in the same manner as the test structure 60. Specifically, for example, a plurality of antenna elements 20 can be made from boards or layers such as those shown in FIGS. 9 and 10, with the conductive planes 22 and 24, the slots 32, and the feedlines 34 being formed thereon. Additionally, a common radome layer can be attached to this antenna array with an intermediate bonding layer or other suitable attachment means.

One can now appreciate that the present invention provides an antenna wherein radiation occurs at the ground plane thereby allowing a "patchless" construction without coaxial coupling pins and without patch radiators (and the corresponding support layer). The elimination of these conventionally necessary components greatly reduces the cost, weight and/or packaging of the antenna. Moreover, the antenna can be made to achieve the same or better circular polarization qualities and a reduction in cross polarization characteristics.

Although the invention has been shown and described with respect to certain embodiments, it is obvious that equivalent and obvious alterations and modifications will occur to others skilled in the art upon the reading and understanding of this specification. The present invention includes all such alterations and modifications and is limited only by the scope of the following claims.

What is claimed is:

1. An antenna element comprising:

a first conductive plane;

a second conductive plane;

one or more dielectric layers separating the first and second conductive planes;

a resonant cavity formed by a portion of the first conductive plane, a portion of the second conductive plane, and electrical connections extending therebetween;

a slot in the portion of the second conductive plane forming the resonant cavity for coupling electromagnetic signals to or from the resonant cavity; and a feedline extending into the resonant cavity;

wherein the slot has a cross-shape with two slot sections which centrally intersect;

wherein the electrical connections are arranged around the slot in a square with one open corner;

wherein the feedline is aligned with the open corner;

wherein the slot sections are laterally aligned, respectively, between center points of opposite sides of the square;

wherein the feedline is transversely aligned with a center of the slot; and wherein a coaxial connector has its central conductor connected to the feedline and its outer conductor connected to the first conductive plane.

2. An antenna element as set forth in claim 1, comprising two dielectric layers separating the first and second conductive planes and wherein the feedline is positioned between the two dielectric layers.

3. An antenna element as set forth in claim 2, further comprising a bonding layer between the two dielectric layers.

4. An antenna element as set forth in claim 1, wherein the electrical connections comprise a plurality of plated vias.

5. An antenna element as set forth in claim 1, wherein dimensions of the cavity are selected so that the resonant cavity resonates at a frequency of about 44–45 Ghz.

6. An antenna element as set forth in claim 1, further comprising a radome layer adjacent the second conductive plane.

7. An antenna array incorporating a plurality of the antenna elements set forth in claim 1.

8. An antenna array comprising a two-by-two array of the antenna elements set forth in claim 1.

9. An antenna array comprising eight two-by-two arrays of the antenna elements set forth in claim 1.

10. A method of making an antenna array incorporating a plurality of the antenna elements set forth in claim 1, said method comprising the steps of stacking a plurality of boards and forming electrical connections therebetween.

11. A method as set forth in claim 10, wherein a first of the plurality of boards is made of a dielectric material and has a first conductive coating on one surface thereof forming the first conductive plane for each of the plurality of antenna elements;

wherein a second of the plurality of boards is made of a dielectric material and has a second conductive coating on one surface thereof forming the second conductive plane for each of the plurality of antenna elements;

wherein a plurality of slots are formed in the second conductive coating to form the slot for each of the plurality of antenna elements; and wherein the second board has feedline circuitry formed on a surface opposite the surface forming the second conductive plane, the feedline circuitry forming the feedline for each of the plurality of antenna elements.

12. A method as set forth in claim 11, wherein said step of stacking the plurality of boards comprises placing a third board between the first and second boards, the third board being made of a bond film material and press bonding the boards together.

13. A method as set forth in claim 12, wherein said step of forming electrical connections comprises forming a set of plated vias between the first conductive coating and the second conductive coating for each of the plurality of antenna elements.

14. A method as set forth in claim 13, wherein said step of stacking the plurality of boards comprises placing a fourth board made of a radome-appropriate material adjacent the second board to form a radome layer for each of the plurality of antenna elements.

15. A method as set forth in claim 13, further comprising the step of connecting a central conductor of a coaxial connection to the feedline circuitry and connecting the outer conductor of the coaxial connection to the first conductive coating.

16. An antenna element as set forth in claim 1, wherein the cavity is sized to prevent excitation in the cavity mode.

17. An antenna element as set forth in claim 16, wherein the antenna generates circular polarization.

* * * * *